United States Patent [19]

Dudley et al.

[11] Patent Number: 4,705,140

[45] Date of Patent: Nov. 10, 1987

[54] SAFETY CAGE FOR ATTENDING TO LOCKS ON CARGO CONTAINERS

[75] Inventors: Jerry W. Dudley, Seal Beach; Patrick J. Andrich, Redondo Beach, both of Calif.

[73] Assignee: Metropolitan Stevedore Company, Wilmington, Calif.

[21] Appl. No.: 28,124

[22] Filed: Mar. 19, 1987

[51] Int. Cl.[4] ..... A62B 35/00; E04G 3/12

[52] U.S. Cl. ..... 182/3; 182/142; 182/150; 182/113

[58] Field of Search ..... 182/150, 142, 3, 113, 182/129

[56] References Cited

U.S. PATENT DOCUMENTS

| | | | |
|---|---|---|---|
| 2,600,199 | 6/1952 | Brewster | 182/142 |
| 3,302,750 | 2/1967 | Arnold | 182/14 |
| 3,586,125 | 6/1971 | Durand | 182/142 |
| 3,863,736 | 2/1975 | McWilliams | 182/150 |
| 4,010,823 | 3/1977 | Love | 182/142 |
| 4,163,480 | 8/1979 | Highland | 182/150 |
| 4,406,351 | 9/1983 | Littlejohn | 182/47 |
| 4,422,528 | 12/1983 | Patterson | 182/150 |
| 4,425,982 | 1/1984 | Kibbie | 182/3 |
| 4,438,829 | 3/1984 | Waters | 182/150 |
| 4,467,888 | 8/1984 | Hickling | 182/142 |
| 4,478,312 | 10/1984 | Kurtgis | 182/150 |
| 4,538,705 | 9/1985 | Leivestad | 182/142 |
| 4,564,161 | 1/1986 | Frye | 182/150 |
| 4,607,724 | 8/1986 | Hillberg | 182/3 |

FOREIGN PATENT DOCUMENTS

| | | | |
|---|---|---|---|
| 975405 | 9/1975 | Canada | 182/150 |
| 670706 | 6/1979 | U.S.S.R. | 182/150 |

*Primary Examiner*—Reinaldo P. Machado

*Attorney, Agent, or Firm*—Fulwider, Patton, Rieber, Lee & Utecht

[57] ABSTRACT

A safety cage hoisted atop a stack of interlockable cargo containers provides safe access to the locks. The dimensions of the cage are substantially identical to the dimensions of the containers. Eyes in the upper corners of the cage frame are engaged by the container bridle hooks. Hinged deck plates in the corners of the cage open to provide access to the locks immediately below. A reeled tether hanging from a trolley which rolls along the athwartship extension arms of a roof boom hooks onto a worker's safety harness to enable him to leave the cage and reach remote locks in safety. The boom rotates between stowed and deployed positions and is held in place by quick release catches. A spring actuated pin engages a tapered hole to lock the extension arms in place. Baskets disposed along the perimeter of the cage are used for storing the locking cones.

20 Claims, 11 Drawing Figures

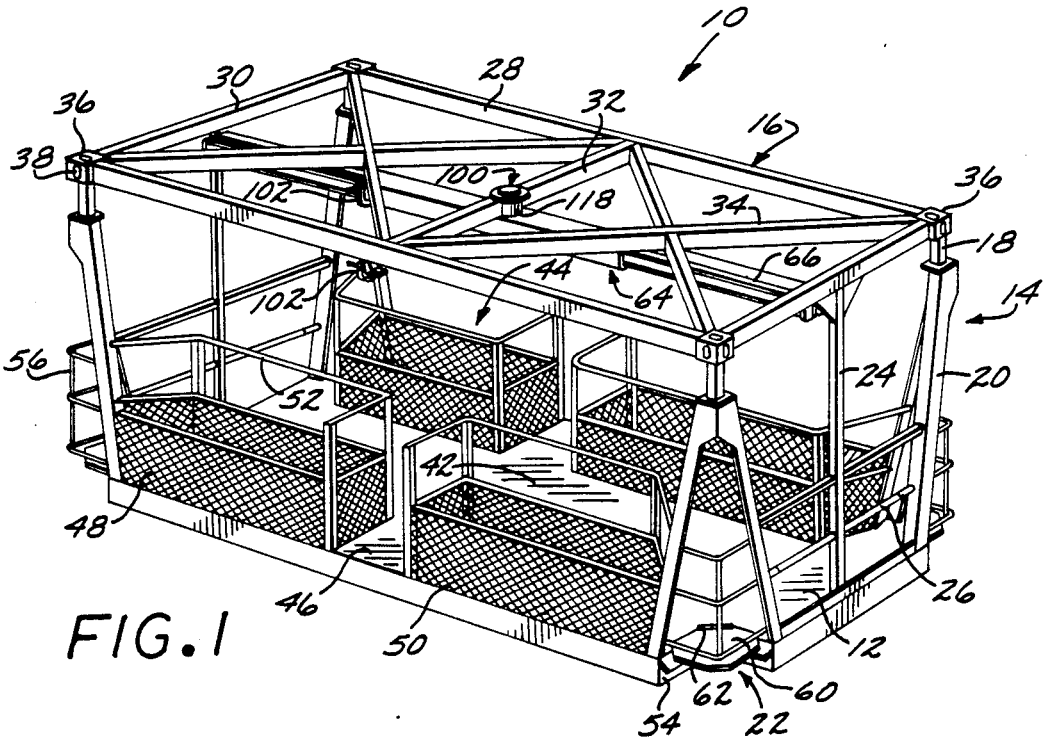
FIG. 1
FIG. 2
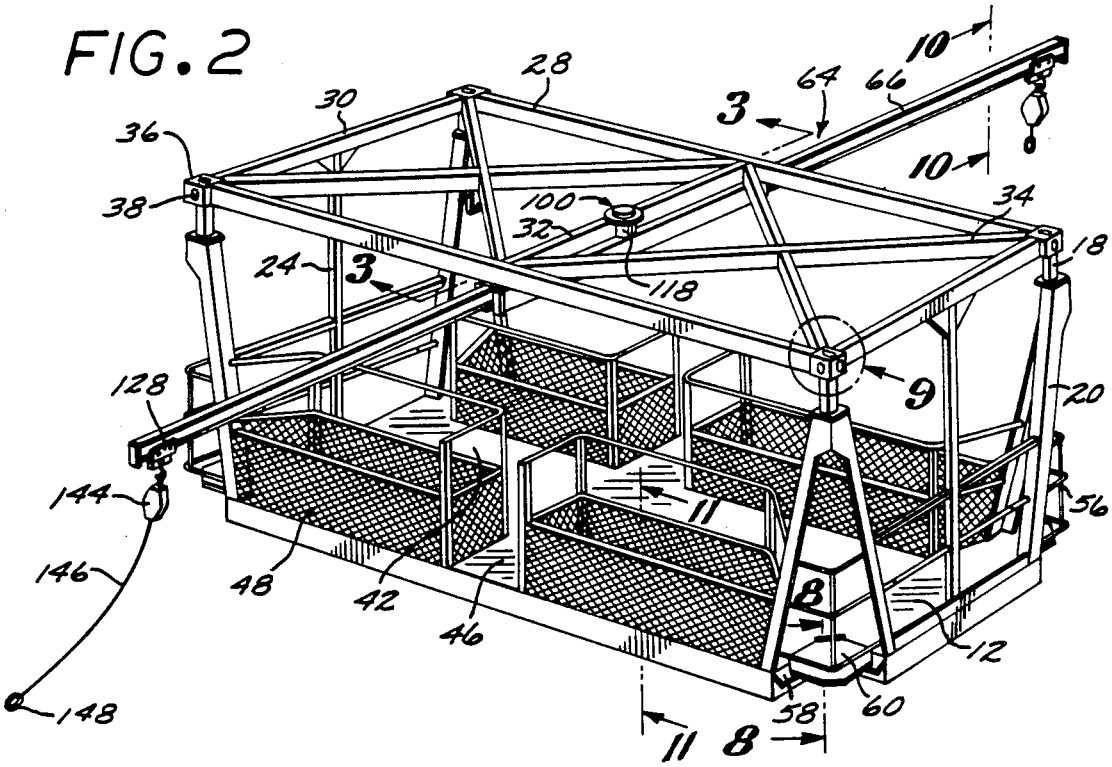

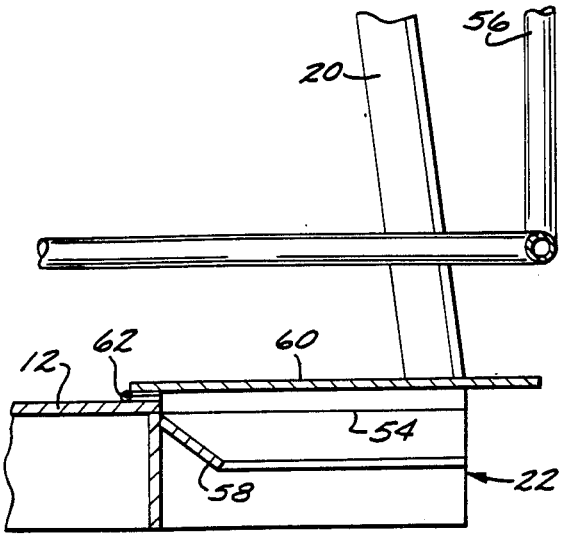
FIG. 8
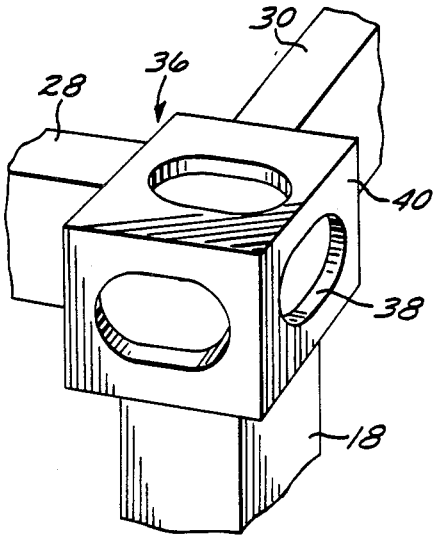
FIG. 9
FIG. 10
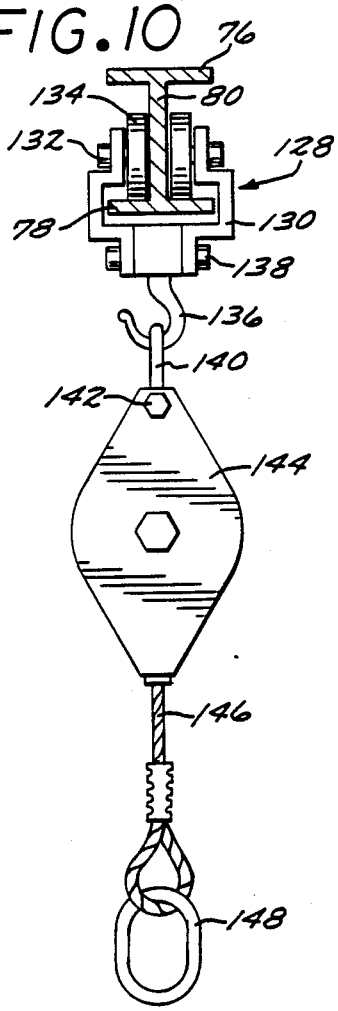
FIG. 11
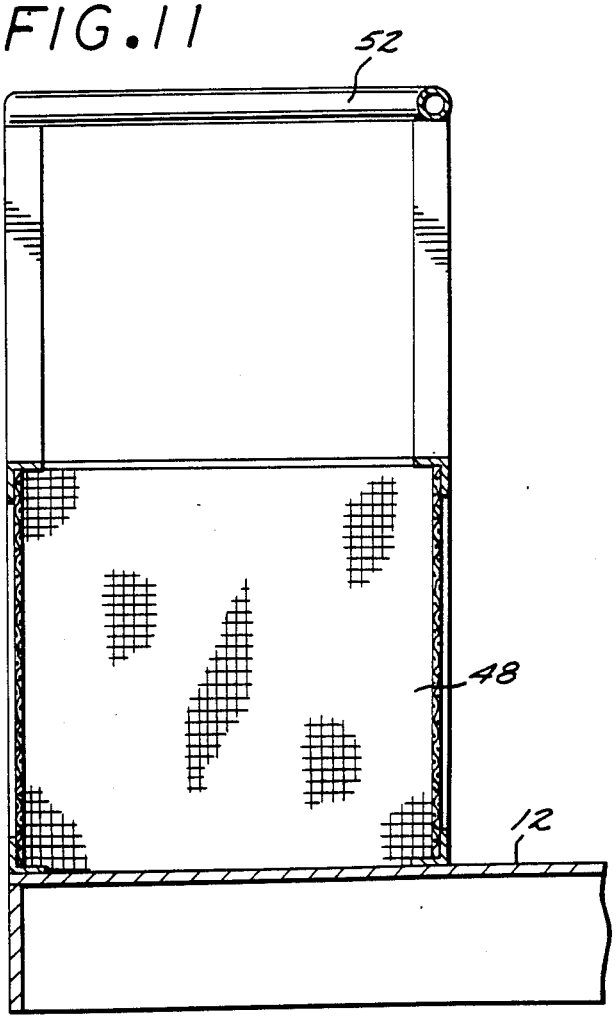

SAFETY CAGE FOR ATTENDING TO LOCKS ON CARGO CONTAINERS

BACKGROUND OF THE INVENTION

1. Field of the Invention

This invention relates generally to the handling of containerized cargo and, more particularly, has reference to a new and improved safety cage used by workers who are attending to the locks on stacks of cargo containers.

2. Description of the Prior Art

Many modern cargo ships carry their loads in large rectangular boxes called containers. These containers are made of steel or some other metal material and are strengthened to withstand stacking and motion at sea. They come in a variety of sizes, but a size of 20'L×8'W×8'H, resembling a large truck van, is considered an industry standard.

The containers are moved about by cranes. Hooks on a bridle suspended by the crane engage eyes in the upper corners of the containers. The crane raises the bridle to hoist the container aloft and move it to a desired location.

The containers are usually stacked one-upon-another and the stacks are placed side-by-side to form rows. Devices called "cones" are used to join and lock the upper corners of adjacent containers and thereby prevent accidental slippage. These cones are placed (for locking) or pulled (for unlocking) by workmen who traverse across the tops of the stacks.

The safety of the workmen attending to the locks is a matter of paramount concern. An ideal safety device would provide effective protection for the workmen, would be convenient and efficient to use, and would be compatible with existing cargo handling procedures and equipment. The various devices currently proposed by others are unsatisfactory in one or more respects. The present invention fulfills all of those needs.

SUMMARY OF THE INVENTION

Briefly, and in general terms, the present invention provides a safety cage which is filled with workmen, hoisted atop a centrally located stack of cargo containers using the existing container handling bridle and crane and then, with no additional movement of the cage, enables the workmen to rapidly and safely gain access to all of the locks in a group of containers arranged in a row.

In a presently preferred embodiment, by way of example and not necessarily by way of limitiation, workmen enter the cage while it is still on the ground. The cage has height, width and length dimensions which are substantially identical to corresponding dimensions of the containers so that the hooks on the normal container handling bridle can readily engage eyes which are formed in blocks in the upper corners of the cage frame. The crane lifts the bridle in the usual manner to hoist the cage and place it atop a centrally located stack of containers.

The cage is set down on top of the stack in alignment with the containers below. Because the dimensions of the cage are substantially identical to the dimensions of the containers, the corners of the cage will be located directly above the locks on the container which is immediately beneath the cage. Hinged deck plates in the corners of the cage are opened by the workmen, enabling them to easily attend to those locks without leaving the safety of the cage. The locking cones are stored in baskets which are positioned along the perimeter of the cage.

The cage has a roof boom with a pair of athwartship extension arms. A cable reel hangs from a trolley on each of the arms. To attend to locks on remote containers with no further movement of the cage, the workmen deploy the boom and hook the cable to a safety harness which they wear. They then leave the cage through an entryway and walk across the tops of the containers toward the remote locks, all the while remaining safely tethered to the boom. The trolley rolls freely along the track and the cable plays out as needed from the reel to provide a wide range of movement.

When the boom is not in use, the extension arms are retracted and the boom is rotated into a compact, stowed position. Quick release catches hold the boom in both the stowed and deployed positions. A fail-safe and positive locking mechanism secures the arms in both the stowed and deployed positions. The mechanism includes a spring actuated pin which engages tapered holes formed in the arms. An arrangement of roller facilitates telescopic movement of the arms.

These and other objects and advantages of the invention will become apparent from the following more detailed description, when taken in conjunction with the accompanying drawings of illustrative embodiments.

DESCRIPTION OF THE DRAWINGS

FIG. 1 is a perspective view of a safety cage embodying features of the present invention;

FIG. 2 is a perspective view of the cage shown in FIG. 1 with extension arms deployed;

FIG. 8 is an enlarged, elevational view, partly in section, taken substantially along the line 8—8 shown in FIG. 2;

FIG. 9 is an enlarged, perspective view of the corner region which is substantially circled in FIG. 2;

FIG. 10 is an enlarged, elevational view, partly in section, taken substantially along the line 10—10 shown in FIG. 2, and FIG. 11 is an enlarged, elevational view, partly in section, taken substantially along the line 11—11 shown in FIG. 2.

DETAILED DESCRIPTION OF THE PREFERRED EMBODIMENTS

Figure 3:
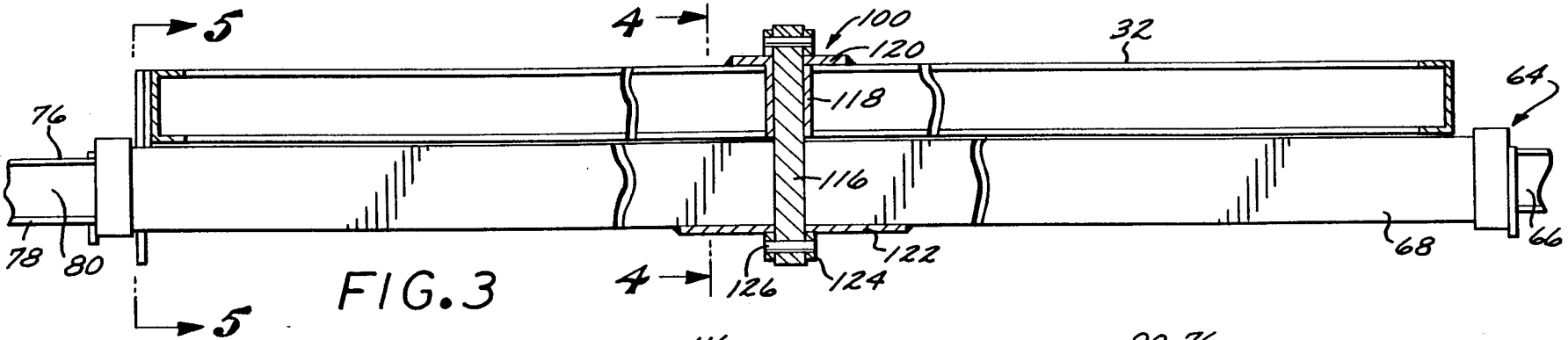
FIG. 3 is an enlarged, elevational view, partly in section, taken substantially along the line 3—3 shown in FIG. 2.

As shown in the drawings for purposes of illustration, and with particular reference FIGS. 1 and 2, the invention is embodied in a safety cage 10 which is adapted to be hoisted atop a stack of interlockable cargo containers (not shown) to provide safe access to the locks in the upper corners of the containers.

The cage 10 is made up of a plurality of various steel members which are welded together to form a substantially rectangular framework structure. The framework generally includes a deck 12, side members 14 extending upright from the deck 12, and a roof frame 16 mounted atop the side members 14.

The deck 12 is formed of sheet steel and rests upon a floor frame (not shown). The side members 14, which are located at the corners of the deck 12, include a corner post 18 which extends upwardly from the top of a pair of downwardly diverging legs 20 positioned astride corner portions 22 of the deck 12. The legs 20 are typically formed of angle iron and are welded to the deck 12 or the floor frame. A center post or stud 24 located between the side members 14 along the short sides of the framework extends between the deck 12 and the roof frame 16 to provide additional support. Transverse railings 26 extending between the side members 14 and the center posts 24 close off the ends of the cage 10.

The roof frame 16 includes a pair of side beams 28 which extend between the side members 14 along the long sides of the framework, a pair of end beams 30 which extend between the side members 14 along the short sides of the framework, and a center beam 32 which extends between the centers of the side beams 28 parallel to the end beams 30. Diagonal braces 34 extend between the corner posts 18 and the ends of the center beam 32 to provide additional structural integrity and rigidity. The ends of the corner posts 18, side beams 28 and end beams 30 are welded to respective adjacent faces of cubical corner blocks 36 which are disposed in the upper corner portions of the framework.

In accordance with one embodiment of the invention, the height, width and length dimensions of the framework are substantially identical to the corresponding dimensions of a standardized cargo container, e.g., 8'H×8'W×20'L, thereby enabling the cage 10 to be moved about by the same equipment used for handling the containers. This equipment typically includes a crane (not shown) and a bridle (not shown).

Cargo containers are usually provided with a hoist attachment mechanism which includes a plurality of eyes formed in the upper corners of the containers. The eyes are configured to be engaged by hooks on a bridle suspended from the container-hoisting crane. As shown in FIG. 9, the cage 10 is provided with a similar hoist attachment mechanism which includes eyes 38 formed in the outer faces 40 of the corner blocks 36. The eyes 38 are configured to be engaged by the bridle hooks for a standard 20' container. Accordingly, the standard container-handling bridle can be attached to the safety cage 10 in the same manner it is attached to the container, i.e., by engaging the bridle hooks in the eyes 38. The bridle can then be used to lift and maneuver the cage 10 into the desired position atop a stack of containers.

Referring again to FIG. 1, the deck 12 has an interior region 42 which is substantially enclosed by the railings 26 and by barriers 44 which extend along the long sides of the cage 10. Openings 46 formed in the center of the barriers 44 act as entryways which enable workmen to enter and exit the interior region 42. In a preferred embodiment of the invention, as shown in FIG. 11, the barriers 44 include wire mesh storage baskets 48 which are disposed along a perimeter region 50 of the deck 12 and handrails 52 formed of pipe stock which are disposed along sides of the baskets 48 adjacent the interior region 42 of the deck 12. The baskets 48 are conveniently used to store the cones (not shown) used in the locks on the containers.

Workmen typically enter the cage 10 through the entryways 46 while the cage 10 is still on the ground. They position themselves in the interior region 42 well clear of the entryways 46 and end railings 26. They grip the handrails 52 to brace themselves for the ride to the top of a stack of containers.

The container bridle is attached to the cage 10 in the manner described above. The crane lifts the bridle in the usual manner to hoist the cage 10 and maneuver it until it is alligned with the top of a centrally located stack of containers. The crane then sets the cage 10 down on top of the stack in alignment with one of the container. Because the planar dimensions of the cage 10 are substantially identical of the planar dimensions of the container, the corner portions 22 of the deck 12 will be located directly above the locks on the container immediately below the cage 10. Hence, the workmen in the cage 10 are able to gain access to those locks without leaving the safety of the cage 10.

After the cage 10 has come to rest onboard the stack of containers, the workmen move toward the corner portions 22 of the deck 12. The interior region 42 is bounded by the baskets 48 and handrails 52 and serves as a convenient walkway. The ends of the baskets 48 terminate at the side member legs 20 and are slanted inwardly away from the corners 22 to provide the workmen with unobstructed access to the corners 22. The workmen brace themselves when they are positioned in the corners 22 by gripping the handrails 52 which extend along the slanted portions of the baskets 48.

The corners 22 of the deck 12 are notched or cut out to form openings 54 between the side member legs 20. The openings 54 are aligned with and configured to expose the locks immediately beneath the cage 10. Workmen in the cage 10 need only reach through the openings 54 and pull or place the cones to unlock or lock the containers as required. Angled quard rails 56 extend between the side member legs 20 and extend out over the openings 54 to provide added safety. The deck 12 has downwardly angled flanges 58 disposed along the openings 54.

Referring to FIGS. 1 and 8, deck plates 60 are disposed between the side member legs 20 and extend across the corner openings 54. The deck plates 60 are connected to the deck 12 by double leaf hinges 62 which allow the plates 60 to be selectively opened and closed. The workmen open the deck plates 60 to expose the corner openings 54 while they are attending to the locks immediately beneath the cage 10 and they close the plates 60 to cover the openings 54 at other times. The lower end of the guard rail 56 is spaced above the deck plates 60 to avoid interference with the plates 60 or with the workmen attending to the locks.

In accordance with yet another aspect of the present invention, the cage 10 is provided with a boom assembly 64 which enables the workmen to rapidly and safely attend to remote locks with no additional movement of the cage 10. The boom 64 rotates between a stowed position (FIG. 1) and a deployed position (FIG. 2). In the deployed position, athwartship extension arms 66 extend out from the sides of the cage 10 and rollably support an extendable tether 146 which connects to the workmen's harness (not shown). The workmen can thus leave the cage 10 and move to remote locations while remaining safely tethered to the boom 64.

Referring to FIGS. 2, 3, 4 and 7, the boom assembly 64 includes a pair of I-beam extension arms 66, preferably sixteen feet in length, which are telescopically disposed in respective rectangular, hollow, channel members 68, preferably eight feet in length. A first pair of upper rollers 70 is rotatably mounted on shafts 71 in each of the channel members 68 adjacent the outer end thereof and a second pair of upper rollers 72 is rotatably mounted on shafts 73 in each of the channel members 68 adjacent the inner end thereof. A pair of lower rollers 74 is also rotatably mounted on shafts 75 in each of the channel members 68 adjacent the inner end thereof at a position slightly inward from the adjacent pair of upper rollers 72. The upper rollers 70 and 72 rollably support the upper flat plate 76 of the extension arms 66 and the lower rollers 74 rollably support the lower flat plate 78 of the extension arms 66. The rollers in each pair of rollers 70, 72 and 74 are disposed on opposite sides of the extension arm web 80. The rollers 70, 72 and 74 facilitate telescopic movement of the arms 66 relative to the channel members 68. The inner end of the channel members 68 is provided both with upper rollers 72 and with lower rollers 74 to account for the shift in weight when the extension arms 66 are deployed outward from the channel members 68. Specifically, when the arms 66 are in a retracted position, the weight of the arms 66 is approximately centered within the channel members 68 and is borne by the upper rollers 70 and 72. When the arms 66 are extended outward from the channel members 68, the weight of the arms shifts outwardly, causing the arms to pivot slightly about the rollers 70 at the outer ends of the channel members 68. In that position, the weight of the arms 66 is borne by the upper rollers 70 adjacent the outer ends of the channel members 68 and by the lower rollers 74 adjacent the inner ends of the channel members 68.

Figure 6:
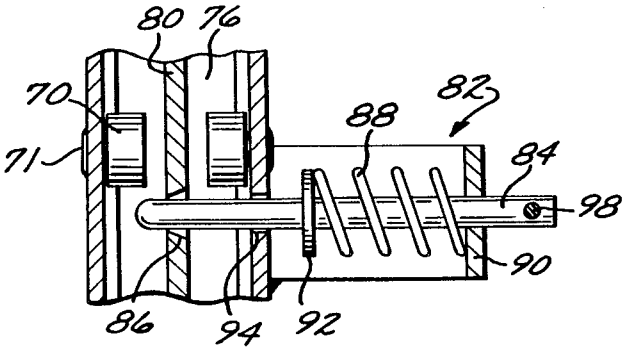
FIG. 6 is an enlarged, plan view, partly in section, taken substantially along the line 6—6 shown in FIG. 5.
Figure 5:
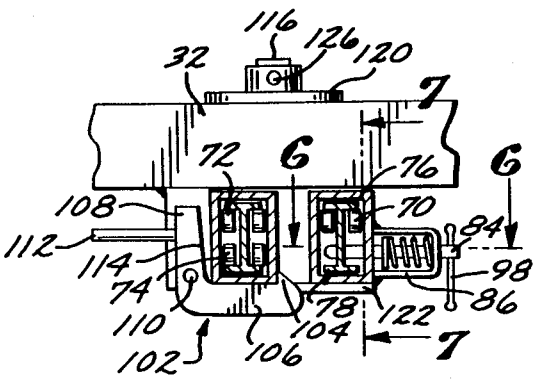
FIG. 5 is an elevational view, partly in section, taken substantially along the line 5—5 shown in FIG. 3.

As shown in FIGS. 5 and 6, a locking mechanism 82 is provided on each of the channel members 68 for locking the extension arms 66 in a fixed position relative to the channel members 68. The mechanism 82 can be configured to lock the arms 66 in any of a variety of positions, but typically only the fully extended and fully retracted positions are selected.

The locking mechanism 82 includes an axially displaceable lock pin 84 which is oriented substantially orthogonal to the web 80 of the extension arm 66 and is mounted in a housing 86 welded to the side of the channel member 68. The pin 84 is biased toward the arm 66 by a helical compression spring 88 which bears against the outer wall 90 of the housing 86 and an annular flange 92 formed on a portion of the pin 84 spaced inwardly from the outer wall 90 of the housing 86. The inner end of the pin 84 extends through an opening 94 formed in the side of the channel member 68 and engages an opening 96 formed in the web 80 of the extension arm 66 to lock the arm in a fixed position relative to the channel member 68. The arm 66 is released from the locked position by pulling on a T-bar handle 98 connected to the outer end of the pin 84. The pulling force displaces the pin 4 away from the arm 66 and causes the inner end of the pin 84 to disengage from the opening 96 in the web 80. Once the arm 66 is displaced from the locked position, it can continue to move relative to the channel member 68 even if the handle 98 is released. The force exerted by the helical spring 88 is sufficiently weak so that the resulting frictional contact between the inner end of the pin 84 and the surface of the web 80 will not significantly hinder the movement of the arm 66.

The location of the opening 96 on the web 80 is selected so that it will align with the opening 94 in the channel member 68 and receive the inner end of the pin 84 under the bias of the spring 88 only when the arm 66 is in the desired position. The web opening 96 is tapered from wide to narrow in the direction away from the channel member opening 94. The wide end of the opening 96 is a fail-safe feature which assists the pin 84 in finding the opening 96 as the arm 66 moves into the vicinity of the desired locked position, even in the event of a slight misalignment between the locking mechanism 82 and the arm. The narrow end of the opening 96 is sized to be commensurate with the outer dimensions of the locking pin 84 so that the arm 66 is positively held in the locked position once the pin 84 engages the opening 96.

Referring again to FIGS. 1 and 2, the boom assembly 64 is suspended from the roof frame 16 by a rotation mount 100 located substantially in the middle of the center beam 32. The rotation mount 100 allows the boom assembly 64 to rotate between a stowed position in which the boom assembly 64 is oriented parallel to the long dimension of the cage 10 (FIG. 1) and a deployed position in which the boom assembly 64 is oriented parallel to the short dimension of the cage 10 (FIG. 2). In the stowed position, the extension arms 66 are fully retracted so that the length of the boom assembly 64 is commensurate with the length of the cage 10 and fits between the center posts 24. When the boom assembly 64 is rigged out, i.e., when it is rotated to the deployed position and the extension arms 66 are fully extended, the preferred boom assembly 64 extends outwardly sixteen feet athwartship on each side of the cage 10.

Figure 4:
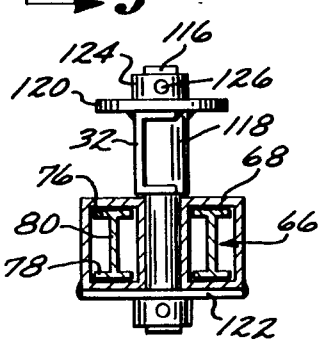
FIG. 4 is an elevational view, partly in section, taken substantially along the line 4—4 shown in FIG. 3.
Figure 7:
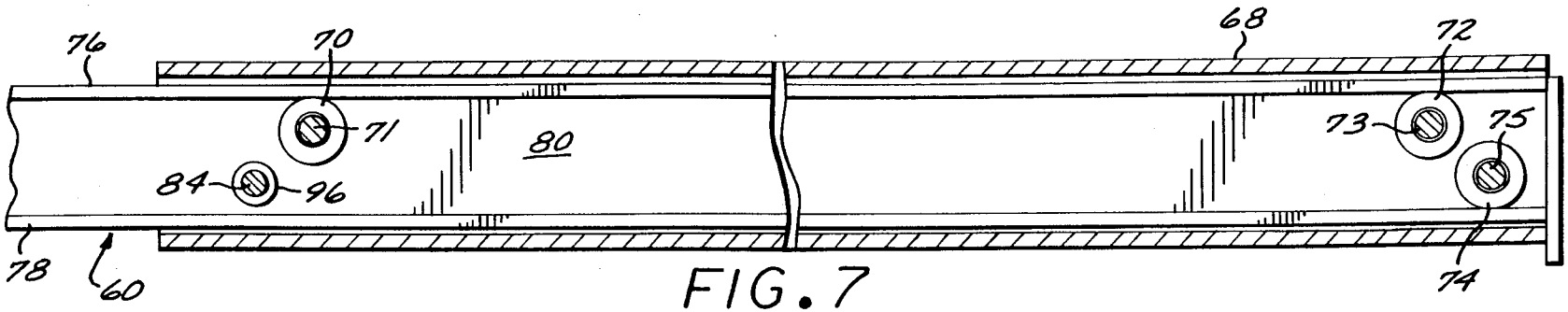
FIG. 7 is an enlarged, elevational view, partly in section, taken substantially along the line 7—7 shown in FIG. 5.

Referring to FIGS. 3 and 4, the rotation mount 100 includes a spindle 116 disposed in a collar 118 which is welded into the center beam 32. A top plate 120 is welded to the top of the center beam 32 in alignment with the collar 118 and a bottom plate 122 is welded to the bottoms of the boom assembly channel members 68 which are disposed on opposite sides of the spindle 116. The spindle 116 extends through the plates 120 and 122 and is provided at both ends with an end bearing 124 which is held in place by a radial pin 126 and which bears against the outer surface of the respective plate 120 and 122. The boom assembly 64, which is welded to the bottom plate 122, rotates about the spindle 116 when a rotational force is applied thereto.

The boom assembly 64 is held against rotation in both the stowed and deployed positions by quick release catches 102 which depend from the roof frame 16. Referring to FIG. 5, the catches 102 have a generally L-shaped configuration. A hook 104 is formed on the end of the lower leg 106. The catch 102 holds the channel member 68 between the hook 104 and the upstanding leg 108 to prevent rotation of the boom 64. The catch 102 is mounted on a pivot 110 located near the junction between the legs 106 and 108. The catch 102 is released by applying an upward force to a handle 112 extending outward from the upstanding leg 108. The force rotates the catch 102 about the pivot 110, causing the hook 104 to disengage from the channel member 68. The inner surface 114 of the upstanding leg 108 is sloped away from the hook 104 to provide clearance for the catch 102 to adequately rotate about the pivot 110.

Referring now to FIGS. 2 and 10, trolleys 128 are mounted on each of the extension arms 66 for movement therealong. The trolley frame 130 extends upwardly around the lower flat plate 78 of the arm 66 and terminates in a pair of roller axles 132 which are disposed on opposite sides of the arm web 80. Rollers 134 rotatably mounted on the axles 132 are supported by the lower plate 78 which acts as a track allowing the trolley 128 to roll freely to and from along the arms 66.

A swivel hook 136 is connected to the lower portion of the trolley frame 130 by a transverse bolt 138. The hook 136 engages a harp shackle 140 which is mounted on a pivot 142 connected to the upper end of a spring-loaded windup reel 144. The reel 144 thus hangs from the trolley 128 and moves therewith along the arm 66. A tether 146 is wound upon the windup reel 144 and extends in varying lengths from the lower end thereof. A connector link 148 is engaged by a loop formed on the end of the tether 146.

The boom assembly 64 is initially secured in the stowed position while the cage 10 is being hoisted atop the stack of containers. When the workmen in the cage 10 are ready to attend to the locks remote from the cage 10, they disengage the catch 22 which holds the boom 64 in the stowed position, rotate the boom 64 to the deployed position, and then engage the catch 102 thereat. The extension arm locking mechanism 82 is then released, the extension arms 66 are deployed to their fully extended position, and the locking mechanism 82 is then re-engaged to fix the arms 66 in place. The workmen then connect the tethers 146 to the safety harnesses which they wear, fastening a snap hook on the harness onto the connector link 148 at the end of the tether 146. Once connected to the tether 146, the workmen leave the cage 10 through the entryways 46 and walk across the tops of the containers to reach the remote locks. The trolley 128 rolls along the extension arm 66 and the tether 146 plays out as needed from the windup reel 144 to permit the workmen a wide range of movement while safely tethered to the boom 64. The workmen can attend to all of the locks in a group of containers arranged in a row, including those locks positioned in remote locations, while the cage 10 remains in a stationary position at the center of the row.

When work on the locks is complete, the workmen return to the cage 10, re-enter through the entryways 46, and disconnect themselves from the tethers 146. They then reverse the deployment procedure to return the boom assembly 64 to the stowed position in preparation for hoisting of the cage 10 and the return trip to the ground.

From the foregoing, it will be appreciated that the present invention provides a safety cage which permits workmen to attend to the locks on cargo containers in a safe and efficient manner, which is convenient to use, and which is compatible with existing cargo handling procedures and equipment.

While particular forms of the invention have been illustrated and described, it will be apparent that various modifications can be made without departing from the spirit and scope of the invention. Accordingly, it is not intended that the invention be limited, except as by the appended claims.

We claim:

1. A safety cage adapted to be hoisted atop a plurality of interlockable cargo containers to provide safe access to locks in upper corners of the containers, comprising:

a substantially rectangular framework including a deck and side members extending upright from said deck, said framework having width and length dimensions substantially identical to corresponding dimensions of said cargo containers, said deck having a perimeter region, an interior region and corner portions, said corner portions having openings formed therein, barrier means disposed along said perimeter regions for substantially enclosing said interior region of said deck, closure means for selectively covering and uncovering said openings in said corner portions of said deck, and hoist attachment means provided on said side members of said framework for detachably connecting said framework to a hoist.

2. Apparatus as set forth in claim 1, wherein:

said closure means comprise deck plates hinged to said deck in said corner portions, said deck plates being configured to extend across said openings when in a closed position.

3. Apparatus as set forth in claim 1, wherein:

said framework further comprises a roof frame mounted atop said side members, said framework further having a height dimension substantially identical to a corresponding height dimension of said cargo containers.

4. Apparatus as set forth in claim 3, wherein:

said roof frame has substantially cubical corner blocks disposed in corner portions thereof, and said hoist attachment means comprises openings formed in faces of said corner blocks.

5. Apparatus as set forth in claim 3, further comprising:

a boom rotatably mounted in a central region of said roof frame, said boom being provided with telescoping extension arms adapted to extend outwardly from said framework.

6. Apparatus as set forth in claim 3, further comprising:

a boom with outward extension arms mounted on said roof frame, a trolley mounted on said arms for movement therealong, and a tether depending from said trolley and being provided with a connector for detachably connecting said tether to a safety harness.

7. Apparatus as set forth in claim 6, further comprising:

a windup reel hanging from said trolley, said tether being wound upon said windup reel.

8. Apparatus as set forth in claim 1, wherein:

said barrier means comprise baskets.

9. Apparatus as set forth in claim 1, wherein:

said barrier means further comprise handrails along portions of said baskets adjacent said interior region of said deck.

10. Apparatus as set forth in claim 1, wherein:

said barrier means is provided with an opening into said interior region of said deck.

11. Apparatus as set forth in claim 1, wherein:

said side members comprise corner posts having spaced apart legs extending downwardly therefrom astride said openings in said corner portions of said deck, said closure means comprise deck plates hinged to said deck in said corner portions, said deck plates being configured to extend across said openings between said legs when in a closed position, and further comprising:

guard rails extending between said legs above said deck plates and positioned outwardly therefrom.

12. Apparatus as set forth in claim 5, further comprising:

quick release catch means connected to said roof frame for holding said boom against rotation.

13. Apparatus as set forth in claim 12, wherein:

said catch means comprises a hook pivotably mounted on said roof frame.

14. Apparatus as set forth in claim 3, further comprising:

a boom mounted on said roof frame having telescoping extension arms adapted to extend outwardly from said framework, and lock means for locking said extension arms in a selected position, said lock means comprising, an axially displaceable pin mounted on said boom substantially orthogonal to said extension arms, and a hole formed in said extension arms for receiving said pin, said hole being tapered away from said pin.

15. Apparatus as set forth in claim 3, further comprising:

a boom mounted on said roof frame, said boom comprising, a channel member, an I-beam arm telescopically disposed in said channel member, upper roller means mounted in said channel member adjacent inner and outer ends thereof for rollably supporting upper portions of said arm, and lower roller means mounted in said channel member adjacent said inner end thereof for rollably supporting lower portions of said arm.

16. A safety cage adapted to be hoisted atop a plurality of interlockable cargo containers to provide safe access to locks in upper corners of the containers, comprising:

a substantially rectangular framework including a deck, side members extending upright from said deck, and a roof frame mounted atop said side members, said deck having a perimeter region and an interior region, barrier means disposed along said perimeter region for substantially enclosing said interior region, said barrier means being provided with an opening into said interior region, a boom rotatably mounted in a central region of said roof frame and being provided with telescoping extension arms adapted to extend outwardly from said frame, and hoist attachment means provided on said framework for detachably connecting said framework to a hoist.

17. Apparatus as set forth in claim 16, further comprising:

quick release catch means connected to said roof frame for holding said boom against rotation.

18. Apparatus as set forth in claim 16, further comprising:

lock means for locking said extension arms in a selected position, said lock means comprising an axially displaceable pin mounted on said boom substantially orthogonal to said extension arms and a hole formed in said extension arms for receiving said pin, said hole being tapered away from said pin.

19. A safety cage adapted to be hoisted atop a plurality of interlockable cargo containers to provide safe access to locks on upper corners of the containers, comprising:

a substantially rectangular framework including a deck, side members extending upright from said deck, and a roof frame mounted atop said side members, said deck having a perimeter region and an interior region, barrier means disposed along said perimeter region for substantially enclosing said interior region, said barrier means being provided with an opening into said interior region, a boom with outward extension arms mounted on said roof frame, a trolley mounted on said arms for movement therealong, a tether depending from said trolley and being provided with a connector for detachably connecting said tether to a safety harness, and hoist attachment means provided on said framework for detachably connecting said framework to a hoist.

20. Apparatus as set forth in claim 19, further comprising:

a windup reel hanging from said trolley, said tether being wound upon said windup reel.

* * * * *

UNITED STATES PATENT AND TRADEMARK OFFICE

CERTIFICATE OF CORRECTION

PATENT NO. : 4,705,140

DATED : November 10, 1987

INVENTOR(S) : Jerry W. Dudley et al.

It is certified that error appears in the above-identified patent and that said Letters Patent is hereby corrected as shown below:

Column 5, line 62, delete "4" and insert --84--.

Signed and Sealed this

Fifteenth Day of March, 1988

*Attest:*

*Attesting Officer*

DONALD J. QUIGG

*Commissioner of Patents and Trademarks*